US007255543B2

(12) United States Patent
Yokoyama

(10) Patent No.: US 7,255,543 B2
(45) Date of Patent: Aug. 14, 2007

(54) SCROLL COMPRESSOR AND AIR-CONDITIONING SYSTEM FOR VEHICLE USING THE SCROLL COMPRESSOR

(75) Inventor: Hiroyuki Yokoyama, Isesaki (JP)

(73) Assignee: Sanden Corporation, Gunma (JP)

( * ) Notice: Subject to any disclaimer, the term of this patent is extended or adjusted under 35 U.S.C. 154(b) by 105 days.

(21) Appl. No.: 11/147,449

(22) Filed: Jun. 8, 2005

(65) Prior Publication Data

US 2005/0271534 A1 Dec. 8, 2005

(30) Foreign Application Priority Data

Jun. 8, 2004 (JP) ..... 2004-170331

(51) Int. Cl.

| | |
|---|---|
| ***F01C 1/02*** | (2006.01) |
| ***F01C 1/063*** | (2006.01) |
| ***F03C 2/00*** | (2006.01) |
| ***F03C 4/00*** | (2006.01) |
| ***F04C 2/00*** | (2006.01) |
| ***F04C 18/00*** | (2006.01) |

(52) U.S. Cl. ..... 418/55.6; 418/55.2; 418/55.1; 418/54

(58) Field of Classification Search ..... 418/55.1–55.6, 418/55

See application file for complete search history.

(56) References Cited

U.S. PATENT DOCUMENTS

| | | | | |
|---|---|---|---|---|
| 1,405,259 | A | | 1/1922 | Beach |
| 1,854,692 | A | | 4/1932 | Cooper |
| 3,317,123 | A | | 5/1967 | Funke |
| 3,499,270 | A | | 3/1970 | Paugh |
| 3,684,412 | A | | 8/1972 | Harlin et al. |
| 3,850,009 | A | | 11/1974 | Villadsen |
| 4,332,535 | A | | 6/1982 | Terauchi et al. |
| 4,343,599 | A | | 8/1982 | Kousokabe |
| 4,360,321 | A | | 11/1982 | Copp, Jr. et al. |
| 4,470,778 | A | * | 9/1984 | Mabe ..... 418/55.6 |
| 4,496,293 | A | | 1/1985 | Nakamura et al. |
| 4,547,138 | A | | 10/1985 | Mabe et al. |
| 4,666,381 | A | | 5/1987 | Butterworth |
| 4,781,550 | A | | 11/1988 | Morishita et al. |
| 4,842,499 | A | | 6/1989 | Nishida et al. |

(Continued)

FOREIGN PATENT DOCUMENTS

DE 2822780 A1 7/1978

(Continued)

*Primary Examiner*—Thomas Denion
*Assistant Examiner*—Douglas J. Duff
(74) *Attorney, Agent, or Firm*—Baker Botts L.L.P.

(57) ABSTRACT

A scroll compressor has a housing, in which are provided fixed and movable scrolls for cooperatively compressing working fluid containing lubricating oil, an oil chamber storing the oil separated from the fluid, and a drive chamber in which a revolving unit for revolving the movable scroll is arranged. The fixed scroll has a communication passage for supplying the stored oil to the drive chamber. The passage has an oil outlet opening in a drive chamber-side end face of the fixed scroll and located in a position which is periodically covered with a base plate of the movable scroll when the movable scroll revolves. A cut is formed in the base plate of the movable scroll and prolongs a time period over which the outlet is opened. The compressor is suited for use in a refrigeration circuit of an air-conditioning system for a vehicle.

18 Claims, 2 Drawing Sheets

U.S. PATENT DOCUMENTS

| | | | | |
|---|---|---|---|---|
| 4,846,640 | A | 7/1989 | Nishida et al. | |
| 4,865,530 | A | 9/1989 | Nishida et al. | |
| 4,892,469 | A | 1/1990 | McCullough et al. | |
| 4,900,238 | A | 2/1990 | Shigemi et al. | |
| 4,932,845 | A | 6/1990 | Kikuchi et al. | |
| 4,936,756 | A | 6/1990 | Shimizu et al. | |
| 4,940,396 | A | 7/1990 | Shimizu et al. | |
| 4,958,991 | A | 9/1990 | Kikuchi | |
| 5,271,245 | A | 12/1993 | Westermeyer | |
| 5,395,224 | A * | 3/1995 | Caillat et al. | 418/55.6 |
| 5,421,708 | A | 6/1995 | Utter et al. | |
| 5,556,265 | A | 9/1996 | Michiyuki et al. | |
| 5,733,107 | A | 3/1998 | Ikeda et al. | |
| 5,800,133 | A | 9/1998 | Ikeda et al. | |
| 6,010,320 | A | 1/2000 | Kwon | |
| 6,017,205 | A | 1/2000 | Weatherston et al. | |
| 6,074,186 | A * | 6/2000 | Lifson et al. | 418/55.6 |
| 6,152,713 | A | 11/2000 | Hisanaga et al. | |
| 6,227,831 | B1 | 5/2001 | Osima et al. | |
| 6,322,339 | B1 | 11/2001 | Mitsunaga et al. | |
| 6,454,538 | B1 | 9/2002 | Witham et al. | |
| 6,485,535 | B1 | 11/2002 | Linnersten et al. | |
| 6,511,530 | B2 | 1/2003 | Iwanami et al. | |
| 6,755,632 | B1 * | 6/2004 | Ito et al. | 418/55.6 |
| 7,101,160 | B2 | 9/2006 | Gennami et al. | |
| 2001/0018025 | A1 | 8/2001 | Sakai et al. | |
| 2002/0134101 | A1 | 9/2002 | Gennami et al. | |
| 2005/0129536 | A1 | 6/2005 | Ohtake | |
| 2005/0129556 | A1 | 6/2005 | Ito | |
| 2005/0226756 | A1 | 10/2005 | Ito | |
| 2005/0265878 | A1 | 12/2005 | Ishida | |
| 2006/0065012 | A1 | 3/2006 | Kudo | |

FOREIGN PATENT DOCUMENTS

| | | | |
|---|---|---|---|
| EP | 0317900 | A2 | 5/1989 |
| JP | S54-047110 | A | 4/1979 |
| JP | S57-143187 | A | 9/1982 |
| JP | S61-205386 | A | 9/1986 |
| JP | S63-016190 | A | 1/1988 |
| JP | S63-106393 | A | 5/1988 |
| JP | H07-151083 | A | 6/1995 |
| JP | 11082335 | | 3/1999 |
| JP | 2000-170681 | A | 6/2000 |
| JP | 2001-295767 | A | 10/2001 |
| JP | 2003-129975 | A | 5/2003 |
| WO | 85/05403 | A1 | 12/1985 |
| WO | 86/00369 | A1 | 1/1986 |

* cited by examiner

SCROLL COMPRESSOR AND AIR-CONDITIONING SYSTEM FOR VEHICLE USING THE SCROLL COMPRESSOR

This non provisional application claims priority under 35 U.S.C. § 119(a) on Patent Application No. 2004-170331 filed in Japan on Jun. 8, 2004, the entire contents of which are incorporated herein by reference.

BACKGROUND OF THE INVENTION

1. Field of the Invention

The present invention relates to a scroll compressor and an air-conditioning system for a vehicle using the scroll compressor.

2. Description of the Related Art

A scroll compressor is used, for example, in the refrigeration circuit of an air-conditioning system for a vehicle. The compressor has a scroll unit contained in a housing thereof and the scroll unit includes a fixed scroll and a movable scroll. Each of the scrolls has a base plate and a spiral wall integral with the base plate. The scrolls are engaged with each other and the spiral walls have respective sliding surfaces in sliding contact with each other's base plates.

Also, a revolving unit is arranged in a drive chamber defined in the housing. Specifically, the revolving unit is located between one inner end wall of the housing and the scroll unit and causes the movable scroll to make revolving motion relative to the fixed scroll. As the movable scroll revolves, the scroll unit performs a series of processes including the suction, compression and discharge of working gas. A discharge chamber, into which the compressed working gas is discharged from the scroll unit, is defined between the other inner end wall of the housing and the scroll unit.

This type of scroll compressor uses, as working gas, a refrigerant containing lubricating oil, and the lubricating oil, if circulated through the refrigeration circuit, lowers the refrigerating capacity of the circuit. To avoid the inconvenience, the scroll compressor disclosed in Unexamined Japanese Patent Publication No. H11-82335, for example, has a separating chamber and an oil chamber, both adjoining the discharge chamber. The lubricating oil is separated from the compressed working gas in the separating chamber and then is stored in the oil chamber. The compressor further includes an oil feed hole extending through the fixed scroll, and the oil feed hole permits only the lubricating oil to be returned to the revolving unit therethrough.

In this conventional compressor, however, the oil feed hole opens in the sliding surface of the fixed scroll, and the opening of the oil feed hole is periodically covered with the base plate of the revolving movable scroll. While the opening is covered with the base plate, the quantity of lubricating oil supplied to the drive chamber through the oil feed hole decreases, hindering the supply of the lubricating oil to the revolving unit. Further, while the opening of the oil feed hole is covered with the base plate, the flow velocity of the lubricating oil in the oil feed hole lowers. Thus, when the opening is uncovered thereafter, the lubricating oil ejected from the opening into the drive chamber may fail to be satisfactorily atomized. With the conventional compressor, therefore, it is possible that the revolving unit is supplied with an insufficient quantity of lubricating oil or that the lubricating oil fails to spread throughout the drive chamber, that is, the revolving unit, due to poor atomization of the lubricating oil.

SUMMARY OF THE INVENTION

An object of the present invention is to provide a scroll compressor which can be kept in a well-lubricated state with simple structure.

Another object of the present invention is to provide an air-conditioning system for a vehicle which uses the scroll compressor and of which the refrigerating capacity is prevented from lowering.

To achieve the first object, the present invention provides a scroll compressor comprising: a housing defining a drive chamber and a discharge chamber therein; a revolving unit arranged in the drive chamber; a scroll unit arranged in the housing and including a fixed scroll having an end face facing the drive chamber and a movable scroll driven by the revolving unit to make revolving motion relative to the fixed scroll, the fixed scroll and the movable scroll cooperating with each other to compress a working fluid containing lubricating oil and to discharge the compressed working fluid into the discharge chamber; and an oil separator for separating part of the lubricating oil from the working fluid discharged into the discharge chamber. The oil separator includes an oil chamber for storing the lubricating oil separated from the working fluid, and a return device for returning the lubricating oil in the oil chamber to the drive chamber. The return device has a communication passage provided in the fixed scroll for guiding the lubricating oil from the oil chamber, the communication passage having an oil outlet opening in the end face of the fixed scroll and located in a position which is periodically covered with the movable scroll when the movable scroll revolves, and prolonging means for prolonging a time period over which the oil outlet is opened.

Specifically, each of the fixed and movable scrolls includes a base plate and a spiral wall integral with the base plate, and the spiral walls of the fixed and movable scrolls have respective sliding surfaces disposed in sliding contact with each other's base plates. The end face of the fixed scroll is substantially flush with the sliding surface of same. The prolonging means includes a cut formed in a covering region of the base plate of the movable scroll, the covering region being a region which periodically covers the oil outlet. The cut may be semicircular in shape.

In the scroll compressor of the present invention, the prolonging means, that is, the cut formed in the covering region of the base plate of the movable scroll, serves to prolong the time period over which the oil outlet is opened by the base plate of the movable scroll. Accordingly, a sufficient quantity of lubricating oil can be returned from the oil chamber to the drive chamber through the communication passage and the oil outlet, and the thus-returned lubricating oil is supplied directly to the revolving unit over a prolonged time period.

Also, since the oil outlet opening time is prolonged, lowering of the flow velocity of the lubricating oil in the communication passage is suppressed, and this makes it possible to satisfactorily atomize the lubricating oil ejected from the oil outlet. The atomized lubricating oil spreads throughout the drive chamber and thus can be supplied to individual sliding parts of the revolving unit, such as bearings, without fail.

In this manner, a large quantity of lubricating oil is returned to the drive chamber and the atomized lubricating oil ejected from the oil outlet is supplied to every part of the revolving unit, whereby the scroll compressor can be kept in a well-lubricated state. Consequently, the service life of the scroll compressor can be prolonged despite its simple structure, and also since the power loss can be reduced, the compressor has improved compression efficiency.

Preferably, the cut is formed over the entire covering region, and in this case, the oil outlet is never covered with the base plate of the movable scroll. With this arrangement, an increased quantity of lubricating oil can be returned to the drive chamber and the revolving unit can be directly supplied with the lubricating oil over a longer period of time, whereby various parts of the compressor can be more satisfactorily lubricated.

The fixed scroll preferably has a recess formed in a region of the sliding surface thereof surrounding the oil outlet. The recess serves to prevent abrasion powder from collecting in the vicinity of the oil outlet, thereby preventing the oil outlet from being clogged with such abrasion powder.

Preferably, the oil separator further includes an oil separating pipe arranged in a separating chamber. In this case, the oil separating pipe serves to separate the lubricating oil more effectively from the working fluid.

Also, preferably, the return device further includes an orifice tube forming part of the communication passage. The orifice tube serves to increase the flow velocity of the lubricating oil returned therethrough, whereby the lubricating oil ejected from the oil outlet can be atomized without fail.

Preferably, the return device further includes a filter surrounding one end of the orifice tube. The filter prevents clogging of the orifice tube, thus ensuring return of the lubricating oil to the drive chamber.

The scroll compressor may further comprise an electromagnetic clutch capable of intermittently transmitting motive power to the revolving unit. In this case, the scroll compressor can intermittently receive power of an engine through the electromagnetic clutch and thus can be easily applied to the refrigeration circuit of an air-conditioning system for a vehicle.

To achieve the second object, the present invention provides an air-conditioning system for a vehicle comprising: a fluid circulation line through which refrigerant as the working fluid is circulated; and the scroll compressor inserted in the fluid circulation line.

With the air-conditioning system for a vehicle of the present invention, the compressed refrigerant delivered from the compressor contains almost no lubricating oil, and therefore, lowering of the refrigerating capacity of the refrigeration circuit can be prevented.

A further scope of applicability of the present invention will become apparent from the detailed description given hereinafter. However, it should be understood that the detailed description and specific examples, while indicating preferred embodiments of the invention, are given by way of illustration only, since various changes and modifications within the spirits and scope of the invention will become apparent to those skilled in the art from this detailed description.

BRIEF DESCRIPTION OF THE DRAWINGS

The present invention will become more fully understood from the detailed description given hereinafter and the accompanying drawings which are given by way of illustration only, and thus, are not limitative of the present invention, and wherein.

DETAILED DESCRIPTION

Figure 1:
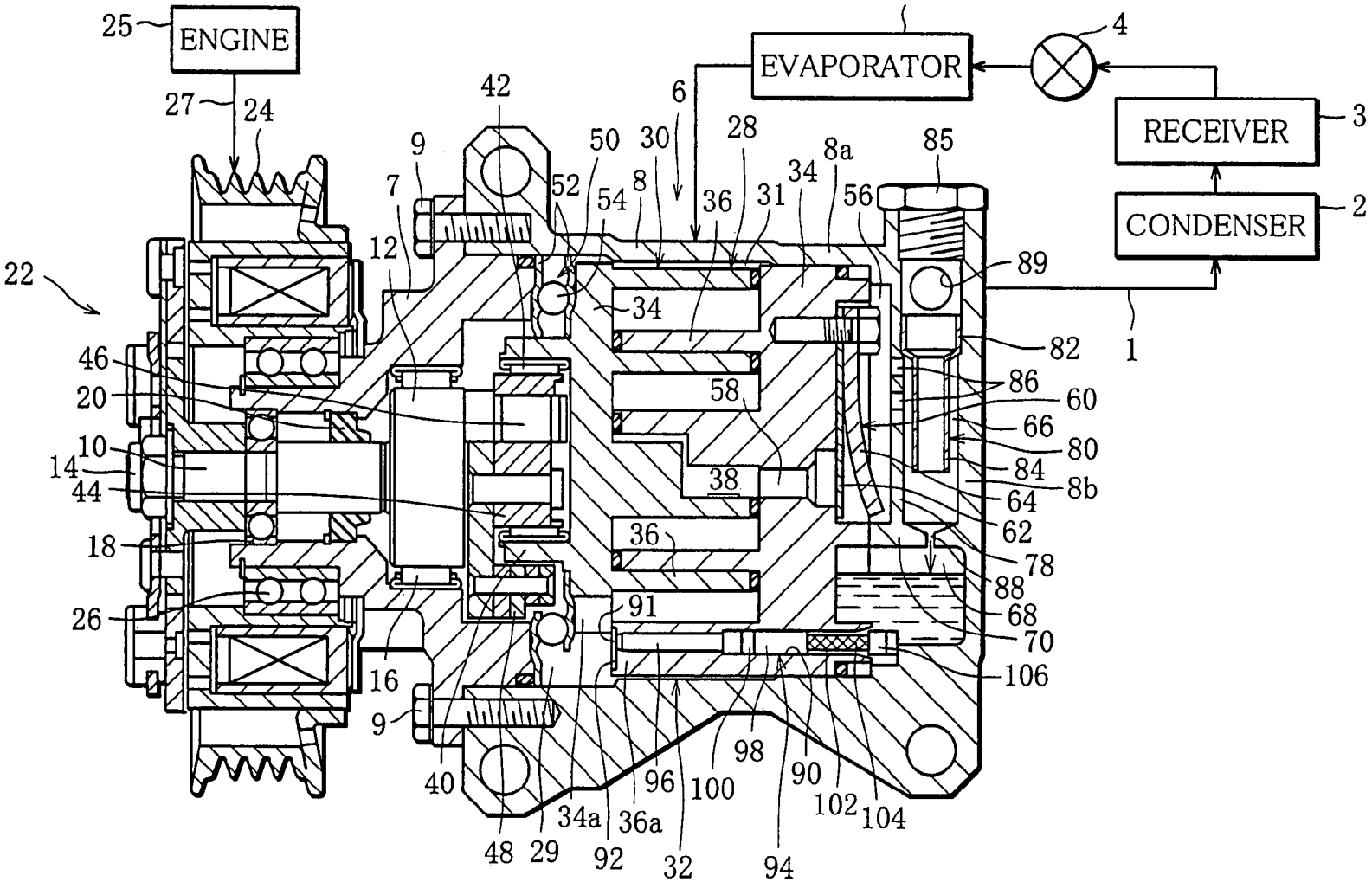
FIG. 1 is a longitudinal sectional view of a scroll compressor according to one embodiment of the present invention, which is applied to a refrigeration circuit of an air-conditioning system for a vehicle.

FIG. 1 shows a scroll compressor according to one embodiment of the present invention, which is applied to a refrigeration circuit of an air-conditioning system of a motor vehicle.

The scroll compressor is inserted in a fluid circulation line 1 of the refrigeration circuit through which refrigerant as working fluid is circulated. Also, in the fluid circulation line 1, a condenser 2, a receiver 3, an expansion valve 4 and an evaporator 5 are arranged downstream of the compressor, as viewed in the circulating direction of the refrigerant, in the order mentioned. The compressor compresses the refrigerant and delivers the compressed refrigerant to the condenser 2, so that the refrigerant circulates through the fluid circulation line 1. The refrigerant contains lubricating oil, and the lubricating oil in the refrigerant serves to lubricate bearings and various sliding surfaces of the compressor as well as to seal up gaps between such sliding surfaces.

The scroll compressor comprises a housing 6 including a drive casing 7 and a compression casing 8. The drive and compression casings 7 and 8 are coupled together by a plurality of connecting bolts 9. In this compressor, the lubricating oil is stored in the bottom of the compression casing 8, as described later, and therefore, the compressor is placed in the engine compartment of the vehicle so as to be vertically oriented in substantially the same manner as illustrated in FIG. 1.

A drive shaft 10 is arranged in the drive casing 7, and has a large-diameter end portion 12 located near the compression casing 8 and a small-diameter axial portion 14 extending from the large-diameter end portion 12. The large-diameter end portion 12 is rotatably supported by the drive casing 7 through a needle bearing 16, while the small-diameter axial portion 14 is rotatably supported by the drive casing 7 through a ball bearing 18. A lip seal 20 is provided around the small-diameter axial portion 14 at a location between the ball bearing 18 and the large-diameter end portion 12. The lip seal 20 is slidable relative to the small-diameter axial portion 14 and serves to airtightly seal the interior of the drive casing 7.

The small-diameter axial portion 14 of the drive shaft 10 projects from the drive casing 7 and has a protruding end fitted with a driven unit of an electromagnetic clutch 22. A driving pulley 24 is rotatably supported by the drive casing 7 through a bearing 26 and constitutes a driving unit of the electromagnetic clutch 22. Thus, rotation of the driving pulley 24 can be transmitted to the drive shaft 10 through the electromagnetic clutch 22.

The driving pulley 24 is connected with an engine 25 of the vehicle through a belt 27, so that the driving pulley 24 is rotated by the motive power from the engine 25. The electromagnetic clutch 22 is energized during operation of the engine 25, whereupon the drive shaft 10 is rotated together with the driving pulley 24.

The compression casing 8 has suction and discharge ports, not shown, formed in a peripheral wall 8*a* thereof, and the suction and discharge ports are connected to the evaporator 5 and condenser 2, respectively, via the fluid circulation line 1.

A scroll unit 28 is housed in the compression casing 8. A drive chamber 29 is defined between the scroll unit 28 and an inner end wall of the drive casing 7, and a suction chamber 31 communicating with the suction port is defined between the peripheral wall 8*a* of the compression casing 8 and the scroll unit 28.

The scroll unit 28 includes a movable scroll 30 and a fixed scroll 32, and the movable and fixed scrolls 30 and 32 each have a base plate 34 and a spiral wall 36 integral with the base plate 34. The base plate 34 of the movable scroll 30 has a diameter smaller than that of the base plate 34 of the fixed scroll 32 and has a semicircular cut 34*a* formed in an outer peripheral portion thereof, as described later.

As is clear from FIG. 1, the movable and fixed scrolls 30 and 32 are arranged such that the base plates 34 thereof face each other with the spiral walls 36 meshed with each other. The distal end faces of the two spiral walls 36 are disposed in sliding contact with each other's base plates 34 with a tip seal therebetween and also the spiral walls 36 locally come into sliding contact with each other, whereby a compression chamber 38 is defined between the movable scroll 30 and the fixed scroll 32. As the movable scroll 30 revolves, the suction process for introducing the refrigerant into the compression chamber 38 and the refrigerant compression/discharge process are successively carried out.

To cause the movable scroll 30 to make revolving motion, a revolving unit is arranged in the drive chamber 29. More specifically, the base plate 34 of the movable scroll 30 has a boss 40 projecting towards the drive casing 7, and the boss 40 is rotatably supported by an eccentric bush 44 through a needle bearing 42. The eccentric bush 44 is supported by a crankpin 46 projecting from the large-diameter end portion 12 of the drive shaft 10 eccentrically therewith. Consequently, as the drive shaft 10 is rotated, the movable scroll 30 makes revolving motion by the action of the crankpin 46 and the eccentric bush 44.

A counterweight 48 for counterbalancing the movable scroll 30 is attached to the eccentric bush 44, and a rotation stopper 50 for preventing the movable scroll 30 from rotating on its own axis is arranged between the drive casing 7 and the movable scroll 30.

More specifically, the rotation stopper 50 has a pair of ring plates 52 supported respectively by the large-diameter end of the drive casing 7 and the base plate 34 of the movable scroll 30. The ring plates 52 have annular races equally spaced in a circumferential direction thereof, and each of the annular races holds a ball 54. The rotation stopper 50 prevents the movable scroll 30 from rotating about the axis of the needle bearing 42.

On the other hand, the fixed scroll 32 is fixed inside the compression casing 8, and a discharge chamber 56 is defined between the base plate 34 of the fixed scroll 32 and an end wall 8*b* of the compression casing 8. The discharge chamber 56 and the compression chamber 38 can communicate with each other through a discharge hole 58 in the fixed scroll 32 and a discharge valve 60.

More specifically, the discharge hole 58 penetrates through the base plate 34 of the fixed scroll 32 around the center thereof and is opened and closed by the discharge valve 60. The discharge valve 60 includes a reed valve element 62 disposed on the same side as the discharge chamber 56 for opening and closing the discharge hole 58, and a stopper plate 64 for restricting the opening of the reed valve element 62. The reed valve element 62 and the stopper plate 64 are attached to the base plate 34 of the fixed scroll 32 by a fixing screw.

The scroll compressor further includes a separating chamber 66 and an oil chamber 68, each formed by partitioning the discharge chamber 56. The discharge chamber 56 surrounding the discharge valve 60 is connected to the aforementioned discharge port via the separating chamber 66.

More specifically, the discharge chamber 56 is partitioned into upper and lower sections by a partition wall 70 extending substantially horizontally, and the partition wall 70 forms a ceiling of the oil chamber 68.

A cylindrical peripheral wall 78, which is integral with the end wall 8*b* of the compression casing 8, extends upward from the upper surface of the partition wall 70 and has an upper end continuous with the peripheral wall 8*a* of the compression casing 8. An oil separating pipe 80 is arranged inside the peripheral wall 78 coaxially therewith, and has a large-diameter end portion 82 fitted in the peripheral wall 78 and a small-diameter portion 84 extending from the large-diameter end portion 82 toward the partition wall 70. The separating chamber 66 has opposite ends defined by the large-diameter end portion 82 of the oil separating pipe 80 and the partition wall 70, respectively, and has a side defined by a part of the peripheral wall 78 extending between the large-diameter end portion 82 and the partition wall 70. The oil separating pipe 80 is inserted into the compression casing 8 through a mounting hole formed through the peripheral wall 8*a* of the casing 8, and after the pipe 80 is set in position, the mounting hole is closed with a sealing bolt 85. To prevent detachment of the oil separating pipe 80, a snap ring (not shown) is placed immediately above the large-diameter end portion 82.

The separating chamber 66 communicates at an upper portion thereof with the discharge chamber 56 via two inlet holes 86 formed through the peripheral wall 78. The inlet holes 86 extend in a direction tangent to an annular space defined between the outer peripheral surface of the small-diameter portion 84 of the oil separating pipe 80 and the inner peripheral surface of the peripheral wall 78. Also, the separating chamber 66 communicates with the oil chamber 68 via a vertical hole 88 formed through the partition wall 70, as well as with a space defined by an upper portion of the peripheral wall 78 via the interior of the oil separating pipe 80. A horizontal hole 89 communicating with the aforementioned discharge port opens in the inner peripheral surface of the upper portion of the peripheral wall 78 and forms a fluid flow path for the compressed refrigerant in cooperation with the discharge chamber 56 and the separating chamber 66.

In the scroll compressor described above, the movable scroll 30 makes revolving motion as the drive shaft 10 rotates, and at this time, the rotation stopper 50 prevents the movable scroll 30 from rotating on its own axis. The revolving motion of the movable scroll 30 causes a periodic movement of the compression chamber 38 toward the discharge hole 58 along the spiral walls 36, and in the process of the movement, the volume of the compression chamber 38 decreases.

As a result, low-pressure gaseous refrigerant in the return path of the fluid circulation line 1 is sucked into the compression chamber 38 through the suction port and the suction chamber 31, and as the compression chamber 38 moves toward the discharge hole 58 and thus the volume thereof decreases, the gaseous refrigerant is compressed. When the compression chamber 38 reaches the discharge hole 58, the pressure of the gaseous refrigerant in the compression chamber 38 surpasses the shutoff pressure of the discharge valve 60, so that the discharge valve 60 opens, allowing the high-pressure gaseous refrigerant to be discharged from the compression chamber 38 into the discharge chamber 56 through the discharge hole 58.

The high-pressure gaseous refrigerant flows from the discharge chamber 56 into the separating chamber 66 through the inlet holes 86 and swirls downward in the annular space of the separating chamber 66 while colliding against the outer peripheral surface of the small-diameter portion 84 of the oil separating pipe 80 and the inner peripheral surface of the peripheral wall 78. At this time, atomized lubricating oil contained in the refrigerant becomes separated due to centrifugal force and adheres to the inner peripheral surface of the peripheral wall 78. The lubricating oil thus separated drips down by its own weight and flows into the oil chamber 68 through the vertical hole 88.

The gaseous refrigerant from which the lubricating oil has been separated enters the oil separating pipe 80 from the lower open end of same, flows upward through the pipe 80, and is delivered to the fluid circulation line 1 through the discharge port.

After being delivered to the fluid circulation line 1, the gaseous refrigerant is cooled and condensed in the condenser 2 and thus turns to high-pressure liquid refrigerant. Then, in the receiver 3, bubbles and moisture are removed from the liquid refrigerant. The high-pressure liquid refrigerant from the receiver 3 is expanded by the expansion valve 4 to be turned to low-pressure gas-liquid refrigerant, which then flows into the evaporator 5. In the evaporator 5, the refrigerant evaporates by absorbing heat of vaporization from outside and turns to low-pressure gaseous refrigerant, which is then again sucked into the compressor.

In the above refrigeration circuit of the air-conditioning system for the vehicle, lubricating oil is separated from the gaseous refrigerant in the separating chamber 66. Since the gaseous refrigerant delivered from the compressor to the fluid circulation line 1 contains almost no lubricating oil, lowering of the refrigerating capacity can be prevented.

The lubricating oil stored in the oil chamber 68 is returned to the drive chamber 29 via a lubricating oil passage explained below, by utilizing a difference in pressure between the drive chamber 29 and the oil chamber 68, and is supplied to the sliding parts constituting the revolving unit, such as the needle bearing 42.

As the lubricating oil passage, a through hole 90 is formed through the fixed scroll 32. The through hole 90 extends from the oil chamber 68 to the distal end face of the spiral wall 36 of the fixed scroll 32.

More specifically, the spiral wall 36 (hereinafter referred to also as fixed spiral wall 36) of the fixed scroll 32 has a shape such that an outer peripheral portion 36*a* thereof located at the bottom of the compression casing 8 has an increased thickness. The through hole 90 extends through the outer peripheral portion 36*a* and base plate 34 of the fixed scroll 32 and is parallel to the axial direction of the drive shaft 10.

The through hole 90 has a small-diameter portion located close to the drive chamber 29 and a large-diameter portion located close to the oil chamber 68. The open end of the large-diameter portion opening into the oil chamber 68 is tapered such that the diameter thereof gradually increases toward the oil chamber 68. The open end of the small-diameter portion opening into the drive chamber 29 is tapered such that the diameter thereof gradually decreases toward the drive chamber. A recess 92 is formed so as to surround the opening 91 of the small-diameter portion.

An orifice filter 94 is inserted into the through hole 90 and includes an orifice tube 96. The orifice tube 96 has an internal passage (not shown) with a very small diameter of about 0.3 mm, for example, for passing the lubricating oil therethrough and is arranged in the through hole 90 coaxially therewith. The orifice tube 96 has a proximal end located near the oil chamber-side open end of the through hole 90, and has a distal end located near the opening 91 of the small-diameter portion. The orifice tube 96 may be obtained, for example, by drawing out a pipe in an axial direction thereof.

A sleeve 98 made of resin is securely fitted around an intermediate portion of the orifice tube 96 and is received in the large-diameter portion of the through hole 90. The sleeve 98 has a peripheral groove cut in an outer peripheral surface thereof, and an O-ring 100 is fitted around the peripheral groove. The O-ring 100 serves to seal up the gap between the sleeve 98 and the through hole 90.

The sleeve 98 has one end abutting against an end face or shoulder of the large-diameter portion adjoining the small-diameter portion of the through hole 90 and has two beams 102 formed integrally with the other end thereof. The beams 102 extend to the oil chamber 68 and a hollow cylindrical filter member 104 is welded to the insides of the beams 102. The filter member 104 concentrically surrounds the proximal end portion of the orifice tube 96 and has opposite ends covered with the other end of the sleeve 98 and a cap 106 welded to the distal ends of the beams 102, respectively.

Thus, the lubricating oil passage is constituted by the through hole 90 and the orifice filter 94 fitted in the through hole 90, and due to a difference in pressure between the oil chamber 68 and the drive chamber 29, the lubricating oil in the oil chamber returns to the drive chamber 29 through the lubricating oil passage. In this case, the lubricating oil is filtered as it passes through the filter member 104 of the orifice filter 94 and then supplied to the drive chamber 29 through the internal passage of the orifice tube 96.

Figure 2:
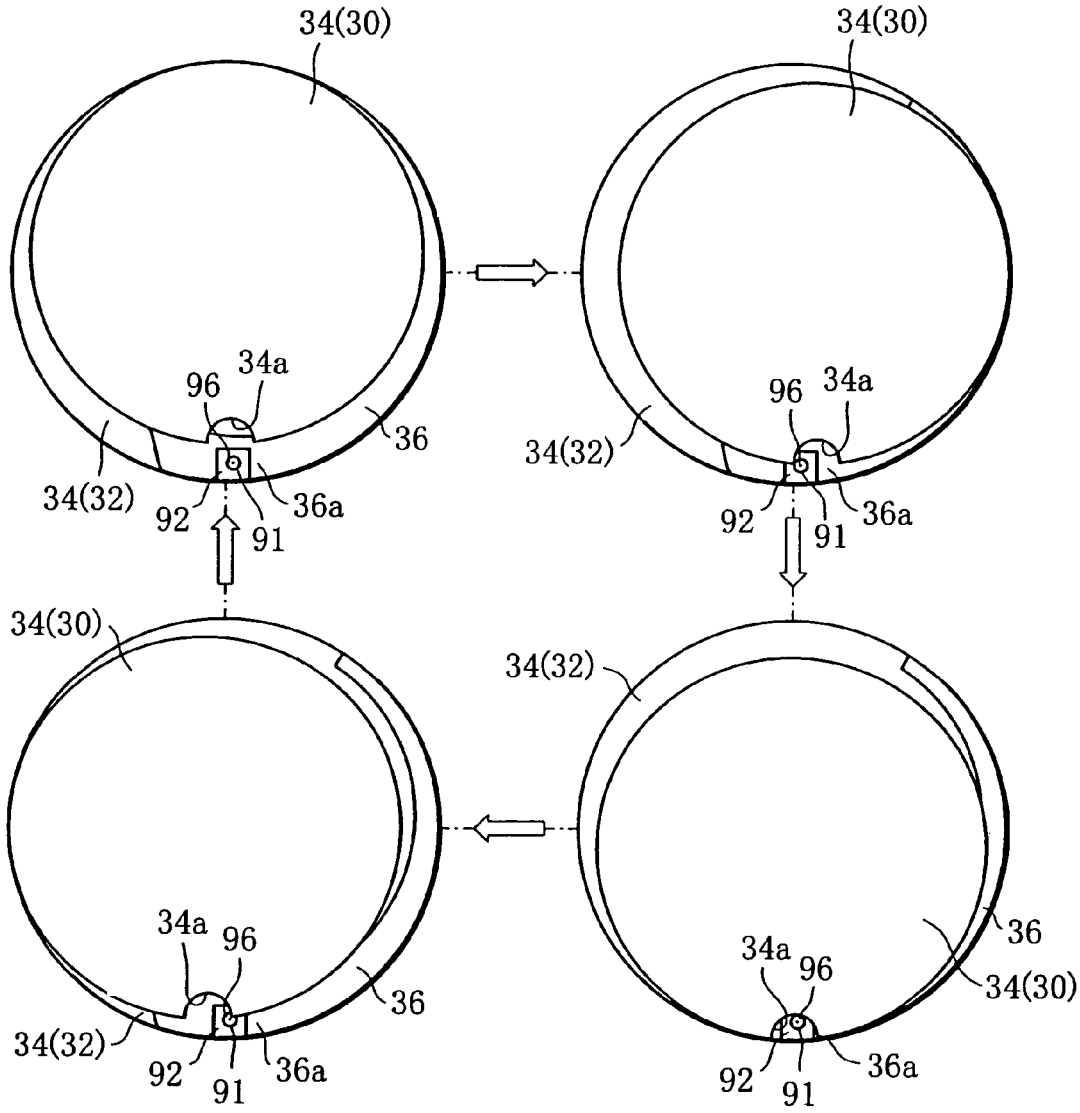
FIG. 2 shows plan views of movable and fixed scrolls of the compressor of FIG. 1, illustrating the positional relationship between an oil outlet and a cut formed in a movable base plate while the movable scroll makes revolving motion relative to the fixed scroll.

In the compressor described above, as the movable scroll 30 makes revolving motion, the base plate 34 (hereinafter referred to also as movable base plate 34) of the movable scroll 30 comes into sliding contact also with the distal end face of the outer peripheral portion 36*a* of the fixed spiral wall 36, as shown in FIG. 2. However, since the semicircular cut 34*a* is formed in the movable base plate 34, the opening 91 (hereinafter referred to also as oil outlet 91) of the through hole 90 is never covered with the movable base plate 34. Namely, the cut 34*a* is formed over a region (entire covering region) of the movable base plate 34 which may otherwise cover at least part of the oil outlet 91 as the movable scroll 30 revolves.

As the oil outlet 91 remains open all the time, it is ensured that the lubricating oil is returned at a sufficient flow rate to the drive chamber 29 via the lubricating oil passage. Also, since the distal end of the orifice tube 96 always faces the drive chamber 29 through the oil outlet 91 and the cut 34*a* without regard to the revolving motion of the movable scroll 30, the lubricating oil can be continuously and directly supplied to the individual sliding parts of the revolving unit.

Further, the flow velocity of the lubricating oil in the lubricating oil passage does not lower because the oil outlet 91 remains open all the time, whereby the lubricating oil ejected from the oil outlet 91 into the drive chamber 29 can be satisfactorily atomized. The atomized lubricating oil spreads throughout the drive chamber 29 and thus can be supplied to every sliding part of the revolving unit without fail.

Meanwhile, FIG. 2 only schematically shows the scroll unit 28 as viewed from the back of the movable base plate 34, and the boss 40 of the movable base plate 34 is not illustrated in the figure.

The present invention is not limited to the foregoing embodiment and may be modified in various ways. For example, the shape of the cut 34*a* is not particularly limited and the cut may be in the form of a rectangle etc. Also, in the case where the outside diameter of the movable base plate is so large that the covering region is located inward of the outer peripheral edge of the movable base plate, an axial hole may be formed through the movable base plate instead of the cut 34*a*.

In the above embodiment, the cut 34*a* is formed over the entire covering region of the movable base plate 34, but may alternatively be formed only in part of the covering region, depending on the flow rate of lubricating oil that needs to be supplied to the drive chamber 29.

Also, in the above embodiment, the fixed scroll 32 has the recess 92 formed in the region of its sliding surface surrounding the oil outlet 91, that is, the oil outlet 91 opens in a bottom plane of the recess 92 which is almost flush with the sliding surface of the fixed scroll 32, but the recess 92 may be omitted. By forming the recess 92, however, it is possible to prevent abrasion powder produced as a result of wear or the like from collecting in the vicinity of the oil outlet 91, whereby the oil outlet 91 can be prevented from being clogged with such abrasion powder or the like.

Further, although the foregoing embodiment includes the oil separating pipe 80 arranged in the separating chamber 66, the oil separating pipe 80 may be omitted. By arranging the oil separating pipe 80 in the separating chamber 66, however, the lubricating oil can be separated from the refrigerant more thoroughly by making the refrigerant containing the lubricating oil efficiently swirl around the oil separating pipe 80.

In the foregoing embodiment, the orifice filter 94 is inserted in the through hole 90, but the lubricating oil passage may alternatively be constituted by the through hole alone. In this case, however, the diameter of the through hole should preferably be as small as possible to increase the flow velocity of the lubricating oil returned via the through hole, and also a filter should preferably be arranged in the oil chamber 68 etc. in order to prevent clogging of the through hole.

Also, in the above embodiment, the through hole 90 is formed in the outer peripheral portion 36*a* of the fixed spiral wall 36, but the through hole may be formed in any other portion of the fixed scroll 32 which is disposed in sliding contact with the movable base plate 34 on the assumption that the movable base plate 34 has no cut formed therein.

Further, in the above embodiment, the fixed scroll 32 and the compression casing 8 are separate from each other, but the fixed scroll may alternatively be provided with an outer peripheral wall serving as part of the compression casing.

In the foregoing embodiment, moreover, the scroll compressor is provided with the electromagnetic clutch 22, but the electromagnetic clutch 22 may be omitted. By providing the scroll compressor with the electromagnetic clutch 22, however, it is possible for the scroll compressor to intermittently receive power of the engine on demand and to be easily applied to the refrigeration circuit of an air-conditioning system for a vehicle.

What is claimed is:

1. A scroll compressor comprising:

a housing defining a drive chamber and a discharge chamber therein;

a revolving unit arranged in the drive chamber;

a scroll unit arranged in the housing and including a fixed scroll having an end face facing the drive chamber and a movable scroll driven by the revolving unit to make revolving motion relative to the fixed scroll, the fixed scroll and the movable scroll cooperating with each other to compress a working fluid containing lubricating oil and to discharge the compressed working fluid into the discharge chamber; and an oil separator for separating part of the lubricating oil from the working fluid discharged into the discharge chamber, the oil separator including an oil chamber for storing the lubricating oil separated from the working fluid, and a return device for returning the lubricating oil in the oil chamber to the drive chamber, the return device having a communication passage provided in the fixed scroll for guiding the lubricating oil from the oil chamber, the communication passage having an oil outlet opening in the end face of the fixed scroll and located in a position which is periodically covered with the movable scroll when the movable scroll revolves, and prolonging means for prolonging a time period over which the oil outlet is opened.

2. The scroll compressor according to claim 1, wherein each of the fixed and movable scrolls includes a base plate and a spiral wall integral with the base plate, the spiral walls of the fixed and movable scrolls having respective sliding surfaces disposed in sliding contact with each other's base plates, the end face of the fixed scroll is substantially flush with the sliding surface of same, and the prolonging means includes a cut formed in a covering region of the base plate of the movable scroll, the covering region being a region which periodically covers the oil outlet.

3. The scroll compressor according to claim 2, wherein the cut is formed over the entire covering region.

4. The scroll compressor according to claim 3, wherein the cut is semicircular in shape.

5. The scroll compressor according to claim 3, wherein the return device further includes a recess formed in a region of the sliding surface surrounding the oil outlet.

6. The scroll compressor according to claim 3, wherein the oil separator further includes a separating chamber for separating the lubricating oil from the working fluid, and an oil separating pipe arranged in the separating chamber.

7. The scroll compressor according to claim 6, wherein the return device further includes an orifice tube forming part of the communication passage.

8. The scroll compressor according to claim 7, wherein the return device further includes a filter surrounding one end of the orifice tube.

9. The scroll compressor according to claim 8, further comprising an electromagnetic clutch capable of intermittently transmitting motive power to the revolving unit.

10. An air-conditioning system for a vehicle comprising:

a fluid circulation line for circulating refrigerant therethrough; and the scroll compressor according claim 1, inserted in the fluid circulation line.

11. An air-conditioning system for a vehicle comprising:

a fluid circulation line for circulating refrigerant therethrough; and the scroll compressor according claim 2, inserted in the fluid circulation line.

12. An air-conditioning system for a vehicle comprising:

a fluid circulation line for circulating refrigerant therethrough; and the scroll compressor according claim 3, inserted in the fluid circulation line.

13. An air-conditioning system for a vehicle comprising:

a fluid circulation line for circulating refrigerant therethrough; and the scroll compressor according claim 4, inserted in the fluid circulation line.

14. An air-conditioning system for a vehicle comprising:

a fluid circulation line for circulating refrigerant therethrough; and the scroll compressor according claim 5, inserted in the fluid circulation line.

15. An air-conditioning system for a vehicle comprising:

a fluid circulation line for circulating refrigerant therethrough; and the scroll compressor according claim 6, inserted in the fluid circulation line.

16. An air-conditioning system for a vehicle comprising:

a fluid circulation line for circulating refrigerant therethrough; and the scroll compressor according claim 7, inserted in the fluid circulation line.

17. An air-conditioning system for a vehicle comprising:

a fluid circulation line for circulating refrigerant therethrough; and the scroll compressor according claim 8, inserted in the fluid circulation line.

18. An air-conditioning system for a vehicle comprising:

a fluid circulation line for circulating refrigerant therethrough; and the scroll compressor according claim 9, inserted in the fluid circulation line.

* * * * *